United States Patent [19]

Nitto et al.

[11] 4,132,342

[45] Jan. 2, 1979

[54] METHOD FOR PRODUCING A STEEL STRIP BY HOT ROLLING

[75] Inventors: Hajime Nitto; Hiromitsu Naito, both of Kitakyusyushi, Japan

[73] Assignee: Nippon Steel Corporation, Otemachi, Japan

[21] Appl. No.: 833,703

[22] Filed: Sep. 15, 1977

[30] Foreign Application Priority Data

| | | | |
|---|---|---|---|
| Sep. 18, 1976 | [JP] | Japan | 51-111975 |
| May 7, 1977 | [JP] | Japan | 52-051743 |
| Aug. 13, 1977 | [JP] | Japan | 52-96577 |
| Aug. 13, 1977 | [JP] | Japan | 52-96598 |

[51] Int. Cl.[2] ..... B23K 19/00

[52] U.S. Cl. ..... 228/136; 29/424; 29/432.2; 29/526 R; 228/139; 228/158; 228/243

[58] Field of Search ..... 29/424, 526, 432, 432.1, 29/432.2; 228/136, 135, 153, 139, 223, 158, 242, 235

[56] References Cited

U.S. PATENT DOCUMENTS

| | | | |
|---|---|---|---|
| 2,438,759 | 3/1948 | Liebowitz | 228/223 X |
| 2,679,468 | 5/1954 | Pitman | 228/135 X |
| 2,761,208 | 9/1956 | Mitchell | 228/158 |
| 2,782,498 | 2/1957 | Mushovic et al. | 228/243 X |
| 3,091,844 | 6/1963 | Laine | 228/135 |
| 3,111,045 | 11/1963 | Dwaki et al. | 29/526 X |
| 3,279,050 | 10/1966 | Simich | 228/158 X |

FOREIGN PATENT DOCUMENTS

| | | | |
|---|---|---|---|
| 591434 | 4/1925 | France | 228/153 |
| 502591 | 11/1954 | Italy | 228/139 |

*Primary Examiner*—Charlie T. Moon

[57] ABSTRACT

In a method for producing a hot strip by hot rough rolling, a steel slab heated to a rolling temperature to obtain a steel band, and hot finishing rolling the steel band in a continuous manner, the improvements comprising overlapping a forward end portion of a steel band which is being rolled by the rough hot rolling over a finishing end portion of a similarly rolled preceding steel band before or during the hot finishing rolling step, with insertion between the overlapped portions of the both hot bands of an oxide scale-fusing agent which reacts with the oxide scale present on the opposing surfaces of the overlapped portions by the heat of the overlapped portions and forms a low-melting point substance, fixing temporarily the overlapped portions by means of a metallic nail-like member driven into the overlapped portions, bonding the overlapped portions by reduction, and subjecting the steel bands thus bonded to the hot finishing rolling continuously.

20 Claims, 3 Drawing Figures

METHOD FOR PRODUCING A STEEL STRIP BY HOT ROLLING

The present invention relates to a method for producing a steel strip by hot rolling in a continuous way.

For producing a hot strip coil from a steel slab, the steel slab is subjected to surface defect detection, and removed of the surface defects by hot scarfing, etc. The steel slab thus surface-conditioned is heated in a reheating furnace, then subjected to rough rolling, intermediate rolling in some cases, finishing rolling, cooling on a run-out table, and is coiled on a coiler. The rolling is intermittently slab by slab. In this case, the forward end of the hot strip coming out of the last stand of the finishing rolling train is normally maintained in a running speed of 1600 to 1800 f.p.m. from while it runs on the run-out table. When the forward end of the hot strip runs on the run-out table at a higher speed, it leaps vigorously, often causing flying. When the forward end of the hot strip is coiled on the coiler, the running speed of the hot strip is increased up to the sped designated by the mill operation or determined by a specific hot strip production line.

In this way, in case of an intermittent rolling procedure in which the rolling is done slab by slab, it is necessary to maintain the running speed of the hot strip while the forward end of the hot strip comes out and reaches the coiler, and the productivity of the hot strip mill is low because an idle time of operation exists between the completion of rolling of a preceding slab and the starting of rolling a subsequent slab.

Further, the temperature of the hot strip lowers considerably before the forward end of the hot strip reaches the coiler, because the running speed of the hot strip is maintained at a remarkably low speed while it comes out of the finishing rolling mill train and reaches the coiler as mentioned above.

In case of rolling a hot strip, however, it is required that the temperature of the hot strip at the exit side of the finishing rolling mill train is within a certain zone in order to maintain a required quality of the hot strip, and for this requirement, the temperature at which the steel slab is extracted from a slab heating furnace must be maintained higher so as to compensate the temperature lowering mentioned before. This is the reason why the heat unit can not be lowered in the hot strip rolling.

Thirdly it is required that the hot strip from its forward end to the finishing end is subjected to a uniform heat history in order to control the quality, but as mentioned before, the running speed of the hot strip must be maintained at a remarkably low speed while the forward end comes out of the finishing rolling mill train and reaches the coiler, so that it is almost impossible to avoid the irregularity of the heat history in the length direction of the hot strip.

Fourthly, the forward end and the finishing end of the hot strip must be cut off, because they are in the tongue-like or fish tail-like shape, thus lowering the production yield.

In order to perform the hot rolling continuously, it has been proposed in Japanese Laid-Open Patent Specification Sho 51-112459 bond successively the steel materials to be rolled. According to this method, the end portion of a preceding steel material being rolled is overlapped with the forward end portion of a subsequent steel material being rolled, and the rolling is done on the overlapped portions to bond the preceding and subsequent steel materials, and thus bonded materials are supplied to the finsihing hot rolling step to perform the hot rolling continuously. In this method, however, it is necessary that both sides of the overlapped portions are temporarily welded, that the thickness of scales on both inside opposing surfaces of the overlapped portions is maintained 40$\mu$ or less, that the length in the rolling direction of the overlapped portions is at least ½ of the width of the steel material being rolled, and that the overlapped portions are rolled with a reduction percentage of 30% or higher at the initial stage of the finishing rolling step.

Therefore, the method according to the above Japanese Laid-Open Patent Specification has disadvantages that a welding machine is required for performing the temporary welding of the both sides of the overlapped portions while the material running, that the production yield is low because of the necessity to overlap the material over a length of at least ½ of the width of the material, and that a rolling equipment of large capacity is required because at least 30% reduction is done on the overlapped portions at the initial rolling of the subsequent material in the finishing rolling mill train.

The object of the present invention is to provide a production method of hot strip by continuous hot rolling which eliminates completely the above problems and disadvantageous confronted with by the conventional methods and can be carried out advantageously on a commercial scale.

The above object of the present invention is achieved by the following features that in a method in which a steel slab heated to its rolling temperature is subjected to a rough hot rolling, an intermediate hot rolling if necessary and a finishing hot rolling to obtain a hot strip, a forward end portion of a steel band rolled by the hot rough rolling and, if necessary, subsequently by the intermediate hot rolling is overlapped with a finishing end portion of a preceding steel band similarly rolled before or during the hot finishing rolling step, with insertion between the overlapped portions of the both hot bands of an oxide scale-fusing agent which reacts with the oxide scale present on the opposing surfaces of the overlapped portions by the heat of the overlapped portions and forms a low melting point substance having high flowability, at least one metallic nail-like member is driven into the overlapped portions to temporarily fixed the overlapped portions, and the overlapped portions are bonded by rolling reduction and subjected to the hot finishing rolling to obtain a steel hot strip continuously.

For the continuous production of the hot strip by the hot rough rolling step, the intermediate rolling step, if necessary, and the hot finishing rolling step, the steel slabs may be bonded one after another before the hot rough rolling or the steel bands after the rough rolling are bonded between the rough rolling step and the finishing rolling step, or in same cases between the intermediate rolling step and the finishing rolling step or the rough rolling step.

However, when the steel slabs are bonded before the hot rough rolling step, the rough rolling step and the finishing rolling step must be associated, but such association through the whole mill stands if difficult to achieved by the present rolling technics, and as the steel slabs have a relatively large thickness the jointed (overlapped) portion after the finishing rolling step occupies a considerable length in the final hot strip which must be cut off, thus resulting in considerable lowering of the production yield.

Whereas, when the steel bands after the rough rolling step are bonded as above, the disadvantages by the slab bonding can be eliminated.

Therefore, the present invention is limited to the bonding of the steel bands after the rough rolling step and thus according to the present invention, the forward end portion of a steel band obtained by the hot rough rolling, or in some cases further by the intermediate rolling is overlapped and bonded with the finishing end portion of a preceding steel band before or during the finishing rolling step.

The bonding, however, must be performed with the following considerations that the bonded portions are not adverse to the rolling condition and the bonding is done in a very short period of time, and the bond strength must stand for at least the rolling under tension in the finishing rolling step.

For the above considerations, the finishing end portion of the preceding steel hot band is overlapped with the forward end portion of the subsequent steel hot band and the overlapped portions are bonded together by pressure in the present invention. As mentioned just above, the strength of the portions bonded by pressure must be enough to stand for the rolling under tension of the steel hot band in the finishing rolling step. The pressure bonding can be achieved by contact bond of the opposing surfaces of the base metals of the overlapped portions of the hot bands. However, the oxide scale present on the surface of the steel band hinders the bonding by pressure of the base metals, and thus the oxide scale must be removed before the bonding. The oxide scale may be removed by a mechanical grinding such as brushing or by a gas grinding such as a hot scarfing using the oxygen gas, but it is extremely difficult to remove the oxide scale from the running steel band in a short time by the above means, and if removed, a new oxide scale is formed soon on the steel band surface and this newly formed oxide scale hinders the bonding.

According to the present invention, for removal of the oxide scale present on the surfaces of the finishing end portion of a preceding steel band and on the surface of the forward end portion of a subsquent steel band, a scale-fusing agent which reacts to the oxide scale at the temperature of the steel bands to be bonded and forms a low melting point substance having high flowability is inserted between the overlapped end portions to be bonded by the rolling and is squeezed out. Together with the low melting point substance being squeezed out, the oxide scale is substantially removed from the band surfaces of the overlapped end portions so that satisfactory bonding of the opposing metal surfaces can be obtained. The temperature of the steel bands at the time of their bonding by pressure is advantageously not less than 1000° C. and as the steel band is supplied to the hot finishing rolling mill train normally at a temperature between about 1000 and 1050° C., a desirable pressure bonding temperature can be maintained without any specific consideration so far as the rolling is done under the ordinary hot rolling conditions.

As the scale-fusing agent used in the present invention, one or more is selected from the group consisting of oxides, complex oxides, chlorides, sulfates, nitrates, carbonates and phosphates in the power form of Li, Na, K, Mg, Ca, Ba, B, Al, Si, Pb, P and Fe which reacts with the oxide scale with the heat (not lower than 1000° C.) contained in the hot steel bands to which the agent is applied and forms a low melting point substance having high flowability.

For the application of the scale fusing agent to the surfaces of the hot steel bands to be bonded together, in case of the oxides or complex oxides, for example boron oxides or complex oxides, they may be applied directly in the form of $B_2O_3$ for example, or they may be applied in the form of boric acid ($H_2BO_3$) which is dehydrated immediately into the boron oxide because the hot band is at high temperatures not lower than 1000° C. so that the same result can be obtained as the boron oxide ($B_2O_3$) is applied. Therefore, in the present invention the oxides or complex oxides include substances which decompose at a temperature not lower than 1000° C. to produce an oxide.

As described above, the scale-fusing agent is applied to the opposing surfaces of the overlapped portions of the hot steel bands and the overlapped portions are bonded by the rolling and the oxide scale which has been converted into the low melting point substance is squeezed out so that a satisfactory bondage between the opposing metal surfaces is obtained. However, in order to assure the bondage, it is necessary to avoid the slipping of the opposing surfaces in the overlapped portions before the completion of the bondage, and it is also necessary to avoid increase in the width and warping of the overlapped portions during the rolling. These requirements are very important because the bonding is done while the hot bands are running.

The slipping between the opposing surfaces of the overlapped portions, and the width increase and warping of the overlapped portions during the rolling can be avoided by temporarily fixing the overlapped portions mechanically, and as the mechanical, temporary fixing means according to the present invention, at least one nail-like member made of carbon steel or low alloy steel, for example, is driven through the overlapped portions to temporarily fixed them. This can be done easily in a very short period of time during the running of the steel bands. As the means for driving the nail-like member through the overlapped portions, it may be done by one or more known nail driving gun of explosion, high pressure gas or compressed air type.

The nail-like member is required to have a strength higher than that required for driving through the overlapped portions at the high temperature, but when the strength of nail-like member is excessively high, it damages the roll surface during the subsequent rolling and thus an excessively high strength of the nail-like member should be avoided. Preferably, nail-like members should be selected which have such a character that the strength lowers as they receive heat from the steel band and becomes almost equal to the strength of the steel band during the subsequent rolling.

The number of the nail-like members to be driven per unit surface area of the overlapped portions should be limited to the minimum required for maintaining the stability of the rolling of the overlapped portions. An excessive number of the nail-like members driven through the overlapped portions will lower the strength of the overlapped portions, often resulting in rupture thereof during the subsequent rolling.

The present invention will be more clearly understood from the following description of preferred embodiments with reference to the attached drawings.

Figure 3:
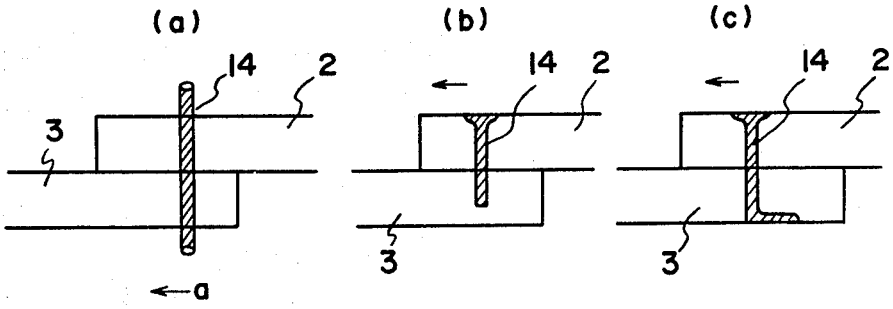

FIG. 3(*a*)(*b*)(*c*) show respectively the modes of during the nail-like members into the overlapped portions.

Figure 1:
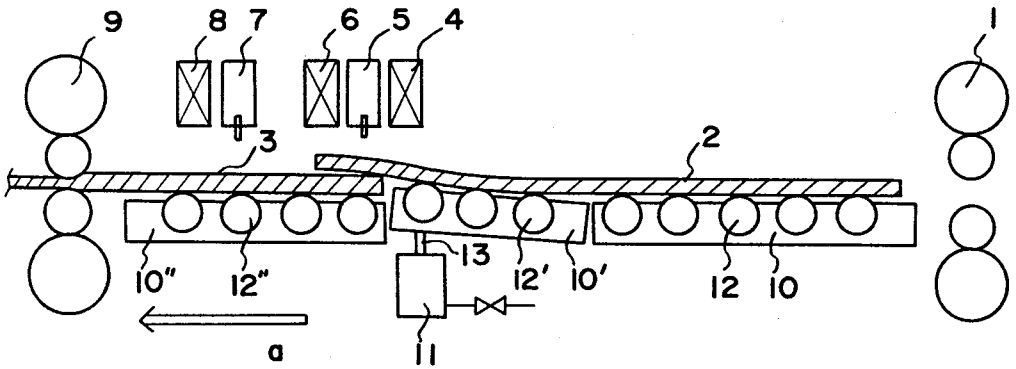
FIG. 1 shows on example of the apparatuses used for carrying out the method according to the present invention.

In FIG. 1, 1 represents the last stand of a hot rough rolling mill train. A hot band 2 prepared by rolling a soaked steel slab in the hot rough rolling mill train comes out of the last stand 1 of the said mill train and advances on the rollers of the delay table in the direction of the arrow (a) to direct to the first stand 9 of a hot finishing rolling mill train. The delay table arranged between the last stand 1 and the first stand 9 is composed of a fixed delay table 10 having rollers 12, a tilting delay table 10′ having rollers 12′ and a fixed delay table 10″ having rollers 12″. The tilting delay table 10′ is so structured as to shift from its horizontal position to its tilted position as the piston rod 13 of the hydraulic unit 11 provided at the forward end rises.

In FIG. 1, the preceding hot rough rolled hot band 3 is shown as having been already introduced into the hot finishing rolling mill train, with its finishing end portion being overlapped with the forward end portion of the subsequent hot band 2. The backward edge of the preceding hot band 3 is detected by an infrared measuring meter 4 positioned above the rear end of the delay table while the hot band 3 is running on the rollers 12″ of the delay table 10″, and the detection signal is sent to a spraying device 5 which stores and sprays the oxide scale fusing agent, and is positioned above the hot band 3 running on the rollers 12″ and in advance to the infrared measuring meter 4 in respect to the advancing direction of the hot band, thereby the spraying device is actuated for a certain constant period of time and the scale fusing agent is sprayed on the upper surface of the finishing end portion of the hot band 3. The infrared measuring meter 4 sends the detection signal to the tilting hydraulic unit 11 upon detection of the backward edge of the hot band 3 and actuate the lifting rod 13 of the unit, and also send the detection signal to the device for controlling the rotation of the rollers 12, 12′ of the delay table 10, 10′ to increase the rotation of the rollers and hence increase the running speed of the hot band 2. Before the detection of the backward edge of the hot band 3, the rotation of the rollers 12, 12′ and 12″ of the delay table 10, 10′ and 10″ are controlled in such a way that the preceding hot band 3 and the subsequent hot band 2 run with a constant space therebetween at the same speed.

As the hydraulic lifting rod 13 rises, the delay table 10′ shifts from its horizontal position to its tilted position as shown, and on the other hand, as the running speed of the hot band 2 is increased over that of the hot band 3 so that the forward end portion of the hot band 2 begins to overlap over the finishing end portion of the preceding hot band 3.

At a forward position in the advancing direction of the hot bands, there is positioned another X-ray measuring meter 6 above the hot band 3. When the forward edge of the hot band 2 is detected by the X-ray measuring meter 6 while it is running and overlapping over the finishing end portion of the hot band 3, the lifting rod 13 of the hydraulic unit 11 is caused to get down to restore the delay table 10′ to its original horizontal state, and at the same time the rotation control device of the rollers 12, 12′ of the delay table 10, 10′ is actuated to synchronize the running speed of the hot band 3 with that of the hot band 2. In this way the overlapping of the end portions of both hot bands is completed. A hammering device 7 is provided in advance of the X-ray measuring meter 6 in the advancing direction of the hot band and above the hot band, and an X-ray measuring meter 8 is provided in advance of the hammering device. The X-ray measuring meter 8 detects the forward edge of the hot band 2 running in the overlapped portions, and the detection signal actuates the hammering device 7 to drive the metallic nail-like members 14 into the overlapped portions of both hot bands, thereby the overlapped portions are temporarily fixed each other.

Figure 2:
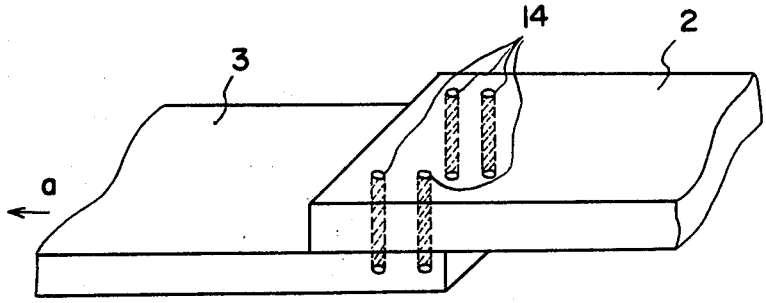
FIG. 2 shows the overlapped portions of the steel bands temporarily fixed by the nail-like members.

The driving of the nail-like members 14 into the operlapped portions may be done in such a manner as they penetrate just across the hot bands 2 and 3 as shown in FIG. 2 or in such a manner as they penetrate the hot bands 2 and 3 with both end projecting out the both surfaces, or penetrate partially across the overlapped portions as shown in FIG. 3(*a*) to (*c*).

Then the temporarily fixed overlapped portions are introduced into the first stand 9 of the hot finishing rolling mill train where they are bonded by rolling reduction. This bonding by rolling reduction may be performed by a pressing means such as a rotary press before the overlapped portions are introduced into the first stand 9.

Then the hot bands thus bonded are continuously subjected to the finishing rolling by the hot finishing rolling mill train. In the above embodiment, the preceding and subsequent hot bands are bonded between the last stand of the hot rough rolling mill train and the first stand of the hot finishing rolling mill train to continuously produce the hot strip. However, without deviating from the scope and spirit of the present invention, the last stand 1 of the hot rough rolling mill train may be replaced by the first stand of the hot finishing rolling mill train, and the first stand 9 of the hot finishing rolling mill train may be replaced by the second stand of the hot finishing rolling mill train so as to bond the hot bands between these stands during the finishing rolling.

Further, the bonding of the preceding and subsequent hot bands may be done in certain cases after an intermediate rolling step following the hot rough rolling step.

Thus, the preceding and subsequent hot bands which have been passed through the intermediate rolling step are bonded between the hot finishing rolling step or during the continuous hot finishing rolling.

The present invention will be more clearly understood from the following examples.

A low-carbon steel slab of 250 mm in thickness and 10 m in length is continuously hot rolled to obtain a steel hot strip.

The above low-carbon steel slabs were soaked to 1200° C., reduced by the hot rough rolling mill train 1 to obtain steel hot bands of 30 mm in thickness, and these hot bands are successively bonded one by one and continuously hot rolled under the conditions shown in the table below.

No. 1 and No. 2 in the table are comparative examples in which no oxide scale fusing agent was applied and the overlapped portions were temporarily fixed by the nail-like members. In Nos. 3, 4, 5, 7, 8, 9, 10 and 11 which are examples of the present invention, the rolling was done following the procedures shown in FIG. 1. In No. 6 which is a modification of the present invention, the bonding of the hot bands was performed during the hot finishing rolling.

As clearly shown in the table, although the temporary fixing by the nail-like members alone permits the subsequent continuous hot rolling, a relatively large number of nail-like members are required for affording an enough bonding strength of overlapped portions which satisfactorily stands for the subsequent hot finishing rolling. The number of the nail-like members driven into the overlapped portions should be appropriate. If the number is too small, the nail-like members will be broken by the tension during the finishing rolling step so that the desired effects of the temporary fixing can not be obtained. On the other hand, if the number is too large, the overlapped portions into which the nail-like members are driven would rupture during the finishing rolling due to too many penetrations by the nail-like members.

| No. | Steel material | Width | Oxide* Scale Fusing Agent | Amount | Overlapping Length | Number of Nail-like Member Driven | Press Bonding Device | Reduction Rate | Temp. at which Bonding is done |
|---|---|---|---|---|---|---|---|---|---|
| | | mm | | $g/m^2$ | mm | | | % | °C |
| 1 | Low-Carbon Steel Slab | 1200 | — | — | 200 | 10 | R.P.** | 40 | 1050 |
| 2 | " | " | — | — | 200 | 20 | $F_1$*** | 30 | 1045 |
| 3 | " | " | No.1 | 30 | 200 | 4 | R.P. | 40 | 1050 |
| 4 | " | " | No.1 | 30 | 200 | 4 | $F_1$ | 30 | 1060 |
| 5 | " | " | No.2 | 100 | 100 | 4 | R.P. | 20 | 1040 |
| 6 | " | " | No.2 | 100 | 100 | 4 | R.P. | 40 | 1010 |
| 7 | " | " | No.2 | 100 | 100 | 4 | R.P. | 20 | 1050 |
| 8 | " | " | No.3 | 100 | 100 | 4 | R.P. | 20 | 1065 |
| 9 | " | " | No.4 | 100 | 100 | 4 | R.P. | 20 | 1055 |
| 10 | " | " | No.5 | 100 | 100 | 4 | R.P. | 20 | 1050 |
| 11 | " | " | No.6 | 100 | 100 | 4 | R.P. | 20 | 1050 |

*Composition of oxide scale fusing agent
No.1: $B_2O_3$(50%) - $Na_2B_4O_7$(50%)
No.2: $B_2O_3$(45.6%) - $SiO_2$(17.5%) - $Na_2O$(25.0%) - $Al_2O_3$(4.5%) - CaO(5.0%) - MgO(2.4%)
No.3: $P_2O_5$(60.9%) - $B_2O_3$(5.3%) - $K_2O$(16.0%) - $Na_2O$(9.8%) - LiO(4.8%) - $Al_2O_3$(3.2%)
No.4: NaCl
No.5: $NaNO_3$
No.6: $Na_2SO_4$
**R.P. = Rotary Press
***$F_1$ = First stand of hot finishing rolling mill train According to the present invention in which the oxide scale-fusing agent is applied to the opposing surfaces of the overlapped portions so that a strong bondage is achieved by pressure between the exposed metal of the opposing surfaces, thus remarkably reducing the required number of nail-like members and affording a continuous and stable hot rolling operation even under the severe conditions in the subsequent hot finishing rolling step.

We claim:

1. In a method for producing a hot strip by hot rough rolling, a steel slab heated to a rolling temperature to obtain a steel band, and hot finishing rolling the steel band in a continuous manner, the improvements comprising overlapping a forward end portion of a steel band which is being rolled by the rough hot rolling over a finishing end portion of a similarly rolled preceding steel band before or during the hot finishing rolling step, with insertion between the overlapped portions of the both hot bands of an oxide scale-fusing agent which reacts with the oxide scale present on the opposing surfaces of the overlapped portions by the heat of the overlapped portions and forms a low-melting point substance, fixing temporarily the overlapped portions by means of a metallic nail-like member driven into the overlapped portions, bonding the overlapped portions by reduction, and subjecting the steel bands thus bonded to the hot finishing rolling continuously.

2. In a method for producing a steel hot strip by hot rough rolling a steel slab heated to a rolling temperature to obtain a steel band and hot finishing rolling the steel band in a continuous manner, the improvements comprising overlapping a forward end portion of a steel band which is being rolled by the rough hot rolling over a finishing end portion of a similarly rolled preceding steel band before or during the hot finishing rolling step, with insertion between the overlapped portions of the both hot bands of an oxide scale-fusing agent which reacts with the oxide scale present on the opposing surfaces of the overlapped portions by the heat of the overlapped portions and forms a low-melting point substance, fixing temporarily the overlapped portions by means of metallic nail-like member driven into the overlapped portions, reducing the thickness of the overlapped portions to squeeze the low melting substance out of the overlapped portions thereby removing the oxide scale from the opposing surfaces of the overlapped portions to expose substantially the base metal and causing bondage therebetween by metal-to-metal contact, and subjecting the steel bands thus bonded to the hot finishing rolling continuously.

3. A method according to claim 1 in which the steel band is subjected to an intermediate rolling after the hot rough rolling.

4. A method according to claim 2 in which the steel band is subjected to an intermediate rolling after the hot rough rolling.

5. A method according to claim 1, in which the oxide scale-fusing agent is at least one selected from the group consisting of oxides, complex oxides, chlorides, sulfates, nitrates, carbonates and phosphates of Li, Na, K, Mg, Ca, Ba, B, Al, Si, Pb, P and Fe.

6. A method according to claim 2, in which the oxide scale-fusing agent is at least one selected from the group consisting of oxides, complex oxides, chlorides, sulfates, nitrates, carbonates and phosphates of Li, Na, K, Mg, Ca, Ba, B, Al, Si, Pb, P and Fe.

7. A method according to claim 5, in which the oxides and the complex oxides include a substance which decompose at the temperature of the steel band to which it is applied to form an oxide.

8. A method according to claim 6, in which the oxides and the complex oxides include a substance which decompose at the temperature of the steel band to which it is applied to form an oxide.

9. A method according to claim 1, in which the oxide scale-fusing agent is applied to the steel band at a temperature not lower than 1000° C.

10. A method according to claim 2, in which the oxide scale-fusing agent is applied to the steel band at a temperature not lower than 1000° C.

11. A method according to claim 1, in which the nail-like member has a strength higher than the strength of the overlapped portions of the hot band at the time of overlapping.

12. A method according to claim 2, in which the nail-like member has a strength higher than the strength of the overlapped portions of the hot band at the time of overlapping.

13. A method according to claim 1, in which the nail-like member is made of a material which will have a final strength equal to that of the overlapped portions of the hot bands when it is effected by the heat of the hot band.

14. A method according to claim 2, in which the nail-like member is made of a material which will have a final strength equal to that of the overlapped portions of the hot bands when it is effected by the heat of the hot band.

15. A method according to claim 1, in which the reduction of the hot bands for their bonding is done by the hot finishing rolling mill stand or by a separate reduction means.

16. A method according to claim 2, in which the reduction of the hot bands for their bonding is done by the hot finishing rolling mill stand or by a separate reduction means.

17. A method according to claim 1, in which the reduction of the hot bands for their bondage is done when the hot bands are at a temperature higher than 1000° C.

18. A method according to claim 2, in which the reduction of the hot bands for their bondage is done when the hot bands are at a temperature higher than 1000° C.

19. A method according to claim 15, in which the reduction of the hot bands for their bondage is done when the hot bands are at a temperature higher than 1000° C.

20. A method according to claim 16, in which the reduction of the hot bands for their bondage is done when the hot bands are at a temperature higher than 1000° C.

* * * * *